US006644763B1

(12) United States Patent
Gothait

(10) Patent No.: US 6,644,763 B1
(45) Date of Patent: Nov. 11, 2003

(54) APPARATUS AND METHOD FOR RAISED AND SPECIAL EFFECTS PRINTING USING INKJET TECHNOLOGY

(75) Inventor: Hanan Gothait, Rehovot (IL)

(73) Assignee: Object Geometries Ltd., Rehovot (IL)

( * ) Notice: Subject to any disclaimer, the term of this patent is extended or adjusted under 35 U.S.C. 154(b) by 192 days.

(21) Appl. No.: 10/009,172

(22) PCT Filed: Jun. 8, 2000

(86) PCT No.: PCT/IL00/00342

§ 371 (c)(1),
(2), (4) Date: Apr. 8, 2002

(87) PCT Pub. No.: WO00/76772

PCT Pub. Date: Dec. 21, 2000

Related U.S. Application Data

(60) Provisional application No. 60/138,541, filed on Jun. 10, 1999.

(51) Int. Cl.[7] ..... B41J 2/01
(52) U.S. Cl. ..... 347/1; 347/102
(58) Field of Search ..... 347/1, 102, 2

(56) References Cited

U.S. PATENT DOCUMENTS 4,303,924 A * 12/1981 Young, Jr. ..... 347/102
5,059,266 A * 10/1991 Yamane et al. ..... 156/64
5,204,055 A 4/1993 Sachs et al.
5,623,001 A 4/1997 Figov

FOREIGN PATENT DOCUMENTS

WO WO 00/76772 A1 6/2000

* cited by examiner

*Primary Examiner*—Craig Hallacher
(74) *Attorney, Agent, or Firm*—Eitan, Pearl, Latzer & Cohen Zedek, LLP.

(57) ABSTRACT

A method for creating raised and special printing effects using inkjet technology is provided. The method includes the steps of depositing a light curable photo-polymer material (18) on the area selected for the printing effects and curing the area. The amount of material to be deposited corresponds to the area selected for the printing effects and the height of the raised area relative to the medium (22) on which the photo-polymer material (18) is deposited.

8 Claims, 1 Drawing Sheet

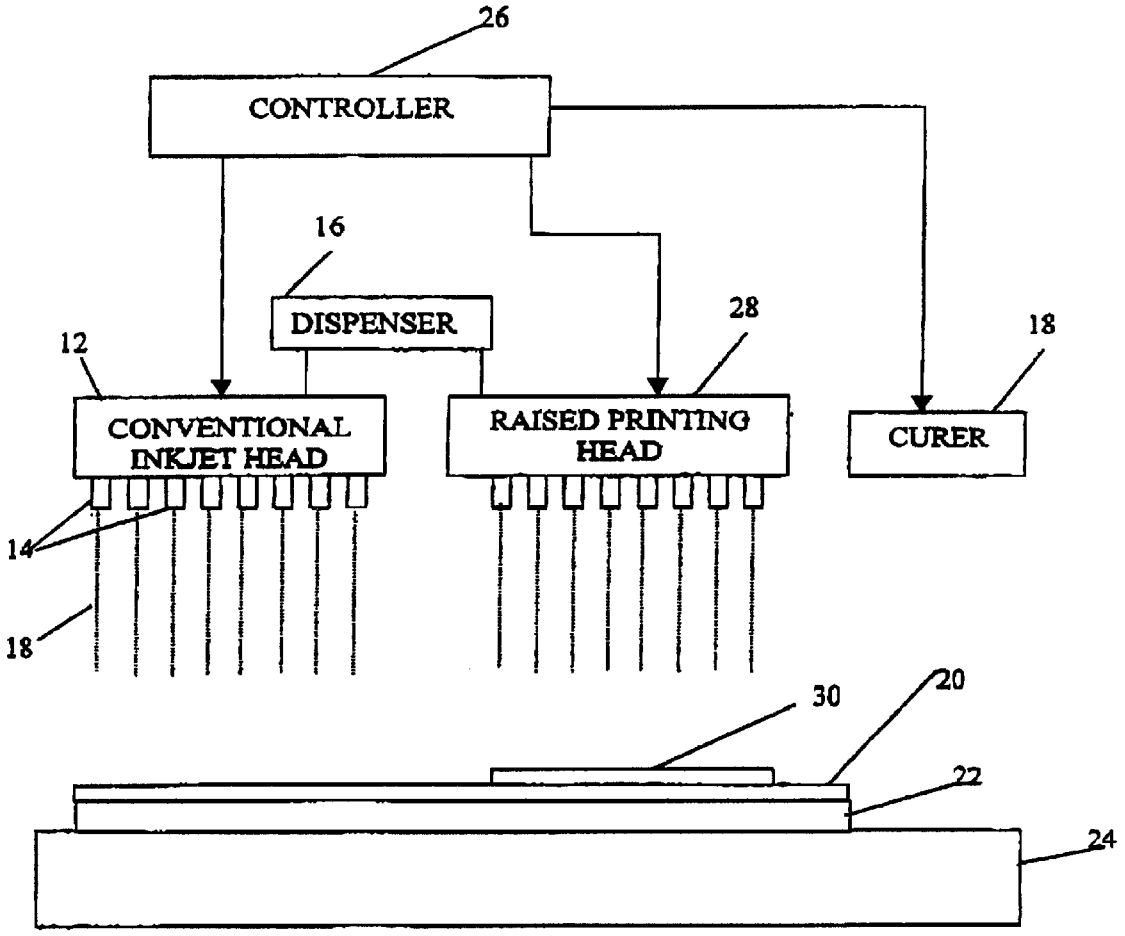
26
CONTROLLER
16
DISPENSER
28
18
12
CONVENTIONAL INKJET HEAD
RAISED PRINTING HEAD
CURER
14
18
30
20
22
24

APPARATUS AND METHOD FOR RAISED AND SPECIAL EFFECTS PRINTING USING INKJET TECHNOLOGY

CROSS REFERENCE TO RELATED APPLICATIONS

This application claims priority from PCT International Application No. PCT/IL00/00342, filed Jun. 8, 2000, entitled "Apparatus And Method For Raised And Special Effects Printing Using Inkjet Technology" which in turn claims benefit from U.S. Provisional Application Ser. No. 60/138,541, filed Jun. 10, 1999 and entitled "Apparatus and Method For Raised And Special Effects Printing Using Inkjet Technology".

FIELD OF THE INVENTION

The present invention relates to the use of three-dimensional printing techniques in the printing of special finishes on a medium, such as paper, using ink-jet techniques.

BACKGROUND OF THE INVENTION

Three-dimensional printing, which works by building parts in layers, is a process used for building three-dimensional objects. Ink-jet printing is the jetting of ink through a row of nozzles of an ink-jet head to create an image on a flat substrate, such as paper. In standard two dimensional printing, the ink-jet printer parallels ink dot lines on a substrate by displacing its print head relative to a substrate in one direction during the actuation of the ink-jet nozzles.

Raised printing is the deposit of ink containing a raising agent on paper to cause the words or images being raised above the plane of the paper. This creates the effect of the words or images standing out from the page in order to emphasize their content. Conventional raised printing is achieved today only using traditional printing methods, utilizing sophisticated and expensive equipment, for which large runs of a particular item must be made in order to justify the use of the raised printing effect.

SUMMARY OF THE INVENTION

The present invention provides a system and method for using a printing head having at least one row of ink-jet nozzles for the printing on paper or other flat media of raised letters, words or images in order to emphasize their content. The present invention provides for the achievement of the raised printing effect in individualized documents produced on standard word processing software operated on personal computing systems, and using desktop ink jet printing devices.

There is thus provided in accordance with a preferred embodiment of the invention, a method for creating raised and special printing effects using inkjet technology. The method includes the steps of depositing a light curable photo-polymer material on the area selected for the printing effects and curing the area. The amount of material to be deposited corresponds to the area selected for the printing effects and the height of the raised area relative to the medium on which the photo-polymer material is deposited.

Furthermore, in accordance with a preferred embodiment of the invention, curing is carried out using ultra violet (UV) or infrared (IR) radiation.

Furthermore, in accordance with a preferred embodiment of the invention, the photo-polymer material further includes an additive formed from any of a group of materials including laquers and coloring agents.

Furthermore, in accordance with a preferred embodiment of the invention, the step of depositing includes the step of jetting the photo-polymer material in layers of predetermined thickness.

In addition, in accordance with a preferred embodiment of the invention, the method further includes the step of coating the cured area with any of a group of materials including laquers and coloring agents.

Furthermore, in accordance with a preferred embodiment of the invention, the step of depositing includes the step of selectively adjusting the output from each of a plurality of ink-jet nozzles, to control the amount of material dispensed from each nozzle.

DESCRIPTION OF THE PRESENT INVENTION

The present invention will be understood and appreciated more fully from the following detailed description taken in conjunction with the appended drawing, FIG. 1, which is a schematic illustration of printing apparatus for raised printing using ink-jet technology.

PCT Patent Application No: PCT/IL00/00123 to the Assignees of the present application, and incorporated herein by reference, describes an apparatus and a method for 3-D model printing. The apparatus of FIG. 1 is similar to the apparatus of PCT Patent Application No: PCT/IL00/00123 and includes a printing head 12 having a plurality of nozzles 14, at least one dispenser 16 connected to the printing head for selectively dispensing interface material 18 is layers and curing means 18 for optionally curing each of the layers deposited. The depth of each deposited layer is controllable by selectively adjusting the output from each of the plurality of nozzles 14.

The printing apparatus further comprises a raised printing head 28, having a plurality of nozzles, similar to the conventional inkjet printing head 12.

The interface material 18 is preferably a photopolymer, containing ultra violet (UV) or infra red (IR) curable material. The operation of the present invention can be described as follows:

The main image 20 is first printed on a suitable medium such as paper 22 which is supported by a table 24 or similar.

After the main printed image has been printed, the user of the apparatus specifies via the controller 26, using a word processing or graphics software package, for example, the areas of the image that are desired to be printed in raised letters, words or images. The user also specifies any other parameters related to the raised image, such as the height of the raised areas, for example, 0.5 mm.

After receiving the print command from the user, the process controller 26 instructs the raised printing head 28 to jet the light curable photo-polymer material 18 onto the area 30 selected for raised printing. This is achieved by extracting the photo-polymer material 18 from the material dispenser 16 and selectively adjusting the output from each of the plurality of ink-jet nozzles 14, to control the amount of material dispensed from each nozzle. The amount of material deposited will correspond to the area selected for raised printing and the height of the raised area relative to the fist medium (such as paper 22) on which the material will be deposited.

The deposited layers are then cured by the application of ultra violet (UV) or infrared (IR) radiation from the curing device 20 in communication with the controller 26.

The cured layers of photo-polymer can be coated with ink-jet materials such as laquers and coloring agents to obtain a desired color effect, for example.

Alternatively, laquers and coloring agents may be mixed with the photo-polymer material 18 used for the main printed image.

The entire flat surface (of the main printed image) is eligible for raised printing by the displacement of the print head perpendicularly to the direction of movement of the medium 22 through the device, and by the advancement of the medium itself through the printer. The rate of advance of the medium will be a function of the height of the raised effect desired and specified by the user. The raised area may comprise a number of layers of the photo-polymer material deposited one upon the other, by any suitable method, such as described in PCT Patent Application No: PCT/IL00/00123 or known in the art.

It will be appreciated that the present invention is not limited by what has been described hereinabove and that numerous modifications, all of which fall within the scope of the present invention, exist. Rather the scope of the invention is defined by the claims, which follow:

What is claimed is:

1. A method for creating raised printing effects on an image printed on a medium, the method comprising:

accepting a user indication of a section of the image on which to create printing effects;

specifying per the user indication a set of areas of the image to be printed with printing effects;

specifying a height, relative to the medium, of the printing to be printed on the set of areas;

depositing a light curable photopolymer material on the set of areas; and curing said areas.

2. The method of claim 1, wherein said step of depositing includes at least selectively adjusting the output from each of a plurality of inkjet nozzles to control the amount of material dispensed from each nozzle.

3. The method of claim 2, comprising, in a continuously variable manner, adjusting the amount of material to be deposited based the set of areas and the height.

4. The method of claim 1, comprising jetting the photo-polymer material in layers of pre-determined thickness.

5. The method of claim 1, comprising curing using ultra-violet radiation.

6. The method of claim 1, comprising curing using infra-red radiation.

7. The method of claim 1, further comprising coating the area cured with lacquers or coloring agents.

8. The method of claim 1, wherein said photopolymer material includes at least an additive formed from lacquers or coloring agents.

* * * * *